US011842689B2

(12) United States Patent
Li et al.

(10) Patent No.: US 11,842,689 B2
(45) Date of Patent: Dec. 12, 2023

(54) PIXEL CIRCUIT, DRIVING METHOD OF PIXEL CIRCUIT AND DISPLAY DEVICE

(71) Applicants: Hefei Xinsheng Optoelectronics Technology Co., Ltd., Anhui (CN); BOE Technology Group Co., Ltd., Beijing (CN)

(72) Inventors: Yongqian Li, Beijing (CN); Xuehuan Feng, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 17/619,829

(22) PCT Filed: Feb. 9, 2021

(86) PCT No.: PCT/CN2021/076182
§ 371 (c)(1),
(2) Date: Dec. 16, 2021

(87) PCT Pub. No.: WO2021/169799
PCT Pub. Date: Sep. 2, 2021

(65) Prior Publication Data

US 2023/0154407 A1 May 18, 2023

(30) Foreign Application Priority Data

Feb. 25, 2020 (CN) ..... 202010115984.3

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01);
(Continued)

(58) Field of Classification Search
CPC ..... G09G 3/3258; G09G 3/3233; G09G 2300/0426; G09G 2300/0819;
(Continued)

(56) References Cited

U.S. PATENT DOCUMENTS

2014/0139569 A1* 5/2014 Yamashita ..... G09G 3/3233 345/691
2015/0294618 A1* 10/2015 Park ..... G09G 3/3291 345/78

(Continued)

FOREIGN PATENT DOCUMENTS

CN 105047138 A 11/2015
CN 105741761 A 7/2016

(Continued)

OTHER PUBLICATIONS

CN 202010115984.3 first office action.

(Continued)

*Primary Examiner* — Tom V Sheng
(74) *Attorney, Agent, or Firm* — IPro, PLLC

(57) ABSTRACT

A pixel circuit, a driving method of pixel circuit, and a display device are provided. The pixel circuit includes: a light emitting device, a driving sub-circuit, an energy storage sub-circuit, a data writing sub-circuit and a pull-down sub-circuit; the data writing sub-circuit is configured to control a voltage signal on a data line to be written into a control end of the driving sub-circuit in response to a data writing control signal; a first end of the driving sub-circuit is electrically connected to a target node, a second end of the driving sub-circuit is electrically connected to a power (Continued)

supply voltage, and the driving sub-circuit is configured to control a conduction of the driving sub-circuit under a control of a voltage on a control end of the driving sub-circuit.

11 Claims, 8 Drawing Sheets

(52) U.S. Cl.
CPC ..... *G09G 2300/0819* (2013.01); *G09G 2300/0842* (2013.01); *G09G 2310/0202* (2013.01); *G09G 2310/0251* (2013.01); *G09G 2310/08* (2013.01); *G09G 2320/0233* (2013.01); *G09G 2320/0257* (2013.01); *G09G 2320/043* (2013.01); *G09G 2320/045* (2013.01); *G09G 2330/021* (2013.01)

(58) Field of Classification Search
CPC ... G09G 2300/0842; G09G 2310/0202; G09G 2310/08; G09G 2310/0251; G09G 2320/043; G09G 2320/045; G09G 2320/0233; G09G 2320/0257; G09G 2330/21
USPC ..... 345/212
See application file for complete search history.

(56) References Cited

U.S. PATENT DOCUMENTS

| | | | | |
|---|---|---|---|---|
| 2016/0189625 | A1* | 6/2016 | Kim | G09G 3/3233 345/205 |
| 2016/0203794 | A1* | 7/2016 | Lim | G09G 3/3225 345/77 |
| 2017/0249904 | A1* | 8/2017 | Li | G09G 3/3233 |
| 2017/0309228 | A1 | 10/2017 | Matsueda et al. | |
| 2018/0047337 | A1* | 2/2018 | Zhu | G09G 3/3233 |
| 2018/0158401 | A1 | 6/2018 | Wang et al. | |
| 2019/0228706 | A1* | 7/2019 | Umeda | G09G 3/3258 |
| 2020/0090591 | A1 | 3/2020 | Wang et al. | |
| 2020/0098316 | A1 | 3/2020 | Yokoyama et al. | |
| 2021/0005139 | A1* | 1/2021 | Ueno | G09G 3/3291 |
| 2021/0049959 | A1* | 2/2021 | Park | G09G 3/325 |
| 2021/0056895 | A1* | 2/2021 | Lee | G09G 3/3233 |
| 2021/0074214 | A1 | 3/2021 | Li et al. | |
| 2021/0111227 | A1* | 4/2021 | Tsuboi | H10K 59/1213 |
| 2021/0158754 | A1* | 5/2021 | Umezawa | G09G 3/3275 |
| 2021/0166630 | A1* | 6/2021 | Kim | G11C 19/28 |
| 2021/0166632 | A1 | 6/2021 | Yang et al. | |
| 2021/0183312 | A1* | 6/2021 | Kim | G09G 3/3266 |
| 2021/0193034 | A1 | 6/2021 | Li | |
| 2021/0343238 | A1* | 11/2021 | Okabe | G09G 3/3275 |
| 2021/0358408 | A1 | 11/2021 | Zhang et al. | |

FOREIGN PATENT DOCUMENTS

| | | | |
|---|---|---|---|
| CN | 106023897 | A | 10/2016 |
| CN | 107086025 | A | 8/2017 |
| CN | 107170407 | A | 9/2017 |
| CN | 107305763 | A | 10/2017 |
| CN | 107507565 | A | 12/2017 |
| CN | 107863067 | A | 3/2018 |
| CN | 107993612 | A | 5/2018 |
| CN | 108288456 | A | 7/2018 |
| CN | 108806595 | A | 11/2018 |
| CN | 109448625 | A | 3/2019 |
| CN | 109584795 | A | 4/2019 |
| CN | 110782820 | A | 2/2020 |
| CN | 111179851 | A | 5/2020 |
| KR | 20200003363 | A | 1/2020 |
| WO | 2018173132 | A1 | 9/2018 |

OTHER PUBLICATIONS

CN 202010115984.3 second office action.
CN 202010115984.3 third office action.
PCT/CN2021/076182 written opinion and international search report.

* cited by examiner

PIXEL CIRCUIT, DRIVING METHOD OF PIXEL CIRCUIT AND DISPLAY DEVICE

CROSS-REFERENCE TO RELATED APPLICATIONS

This application is the U.S. national phase of Application PCT/CN2021/076182 filed on Feb. 9, 2021, which claims priority to Chinese Patent Application No. 202010115984.3 filed in China on Feb. 25, 2020, the entire contents of which are incorporated herein by reference.

TECHNICAL FIELD

The present disclosure relates to the field of display technologies, and in particular, to a pixel circuit, a driving method of pixel circuit, and a display device.

BACKGROUND

An Active Matrix Organic Light Emitting Diode (AMOLED) is one of the hot spots in the research field of flat panel displays, and compared with a Liquid Crystal Display, an OLED has the advantages of low energy consumption, low production cost, self-luminescence, wide viewing angle, and fast response speed, and at present, OLEDs in the Display fields of mobile phones, Personal Digital Assistants (PDAs), Digital cameras, and the like have begun to replace the conventional Liquid Crystal Displays (LCDs). The pixel driving circuit design is the core technical content of the AMOLED display and has important research significance.

In the related art, the OLED display device has a phenomenon of dynamic image smear during the display process of the dynamic image, resulting in a poor display effect.

SUMMARY

A pixel circuit is provided in the present disclosure, including a light emitting device, a driving sub-circuit, an energy storage sub-circuit, a data writing sub-circuit and a pull-down sub-circuit;

the data writing sub-circuit is configured to control a voltage signal on a data line to be written into a control end of the driving sub-circuit in response to a data writing control signal;

a first end of the driving sub-circuit is electrically connected to a target node, a second end of the driving sub-circuit is electrically connected to a power supply voltage, and the driving sub-circuit is configured to control a conduction of the driving sub-circuit under a control of a voltage on a control end of the driving sub-circuit;

the energy storage sub-circuit is electrically connected to the control end of the driving sub-circuit and the first end of the driving sub-circuit and is configured to control a voltage of the target node;

the light emitting device is electrically connected to the target node; and the pull-down sub-circuit is configured to control the voltage of the target node in response to a pull-down control signal, to make the light-emitting device not to emit light.

Optionally, the pull-down sub-circuit includes a first pull-down transistor having a control electrode electrically connected to a pull-down control signal line, a first electrode electrically connected to a pull-down signal line, and a second electrode electrically connected to the target node.

Optionally, the pull-down sub-circuit includes a second pull-down transistor and a third pull-down transistor;

a control electrode of the second pull-down transistor is electrically connected to the pull-down control signal line, a first electrode of the second pull-down transistor is electrically connected to the pull-down signal line, and a second electrode of the second pull-down transistor is electrically connected to the target node;

a control electrode of the third pull-down transistor is electrically connected to the pull-down control signal line, a first electrode of the third pull-down transistor is electrically connected to the target node, and a second electrode of the third pull-down transistor is electrically connected to the control end of the driving sub-circuit.

Optionally, the pull-down sub-circuit includes a fourth pull-down transistor and a fifth pull-down transistor;

a control electrode of the fourth pull-down transistor is electrically connected to the pull-down control signal line, a first electrode of the fourth pull-down transistor is electrically connected to the pull-down signal line, and a second electrode of the fourth pull-down transistor is electrically connected to the target node;

a control electrode of the fifth pull-down transistor is electrically connected to the pull-down control signal line, a first electrode of the fifth pull-down transistor is electrically connected to the pull-down signal line, and a second electrode of the fifth pull-down transistor is electrically connected to the control end of the driving sub-circuit.

Optionally, a voltage signal provided by the data line in a data writing phase is a high-voltage signal, and a voltage signal provided by the data line in a light emitting phase and a black screen display phase is a low-voltage signal;

in the light-emitting stage and the black screen display stage, the data line is reused as the pull-down signal line.

Optionally, the pixel circuit further includes a sensing write sub-circuit configured to control a sense line to connect to the first end of the drive sub-circuit in response to a sensing write control signal.

Optionally, a voltage signal of the sensing line in the data writing phase is a low-voltage signal;

in the data writing stage, the sensing line is reused as the pull-down signal line.

Optionally, the data writing control signal is reused as the sensing write control signal.

A display device including the pixel circuit hereinabove is further provided in the present disclosure.

A driving method of pixel circuit is further provided in the present disclosure, where a display period includes a data writing stage, a light emitting stage and a black screen display stage, the pixel circuit includes a light emitting device, a driving sub-circuit, an energy storage sub-circuit, a data writing sub-circuit and a pull-down sub-circuit;

the data writing sub-circuit is configured to control a voltage signal on a data line to be written into a control end of the driving sub-circuit in response to a data writing control signal;

a first end of the driving sub-circuit is electrically connected to a target node, a second end of the driving sub-circuit is electrically connected to a power supply voltage, and the driving sub-circuit is configured to control a conduction of the driving sub-circuit under a control of a voltage on a control end of the driving sub-circuit;

the energy storage sub-circuit is electrically connected to the control end of the driving sub-circuit and the first end of the driving sub-circuit and is configured to control a voltage of the target node;

the light emitting device is electrically connected to the target node; and the pull-down sub-circuit is configured to control the voltage of the target node in response to a pull-down control signal, to make the light-emitting device not to emit light;

the method includes:

in the data writing phase, the data writing sub-circuit providing a high-voltage signal in the data line to the control end of the driving sub-circuit in response to a data writing control signal, to charge the energy storage sub-circuit to increase a voltage of the control end of the driving sub-circuit;

in the light-emitting stage, the data writing sub-circuit disconnecting with the control end of the driving sub-circuit, and the driving sub-circuit controlling the driving sub-circuit to be conducted under a control of the control end of the driving sub-circuit, to enable the light-emitting device to connect to the power supply voltage end and enable the light-emitting device to emit light;

in the black screen display stage, the pull-down sub-circuit controlling the voltage of the target node in response to a pull-down control signal, to make the light emitting device not emit light.

Optionally, the pull-down sub-circuit includes a second pull-down transistor and a third pull-down transistor; the pull-down sub-circuit controlling the voltage of the target node in response to the pull-down control signal to enable the light emitting device not emit light includes:

the second pull-down transistor controlling a pull-down signal line to pull down the voltage of the target node in response to a pull-down control signal;

the third pull-down transistor pulls down a voltage of the control end of the driving sub-circuit in response to the pull-down control signal, to make the light emitting device not emit light.

Optionally, the pull-down sub-circuit includes a fourth pull-down transistor and a fifth pull-down transistor;

the pull-down sub-circuit controlling the voltage of the target node in response to the pull-down control signal to make the light emitting device not emit light includes:

the fourth pull-down transistor controlling a pull-down signal line to pull down the voltage of the target node in response to a pull-down control signal;

the fifth pull-down transistor pulling down a voltage of the control end of the driving sub-circuit in response to the pull-down control signal, to make the light emitting device not emit light.

Optionally, a voltage signal provided by the data line in the data writing phase is a high-voltage signal, and a voltage signal provided by the data line in the light-emitting phase and the black screen display phase is a low-voltage signal;

in the light-emitting stage and the black screen display stage, the data line is reused as the pull-down signal line.

Optionally, the method further includes a sensing write sub-circuit configured to control a sense line to connect to the first end of the drive sub-circuit in response to a sensing write control signal.

Optionally, the voltage signal of the sensing line in the data writing phase is a low-voltage signal;

in the data writing stage, the sensing line is reused as the pull-down signal line.

Optionally, the data writing control signal is reused as the sensing write control signal.

BRIEF DESCRIPTION OF THE DRAWINGS

In order to more clearly illustrate the technical solutions of the embodiments of the present disclosure, the drawings required to be used in the description of the embodiments of the present disclosure will be briefly introduced below, and it is apparent that the drawings in the following description are only some embodiments of the present disclosure, and it is obvious for those skilled in the art that other drawings may be obtained according to the drawings without inventive labor.

DETAILED DESCRIPTION

The technical solutions in the embodiments of the present disclosure will be described clearly and completely with reference to the accompanying drawings in the embodiments of the present disclosure, and it is to be understood that the described embodiments are only some embodiments, but not all embodiments, of the present disclosure. All other embodiments, which can be derived by a person skilled in the art from the embodiments disclosed herein without inventive step, are intended to be within the scope of the present disclosure.

Figure 1:
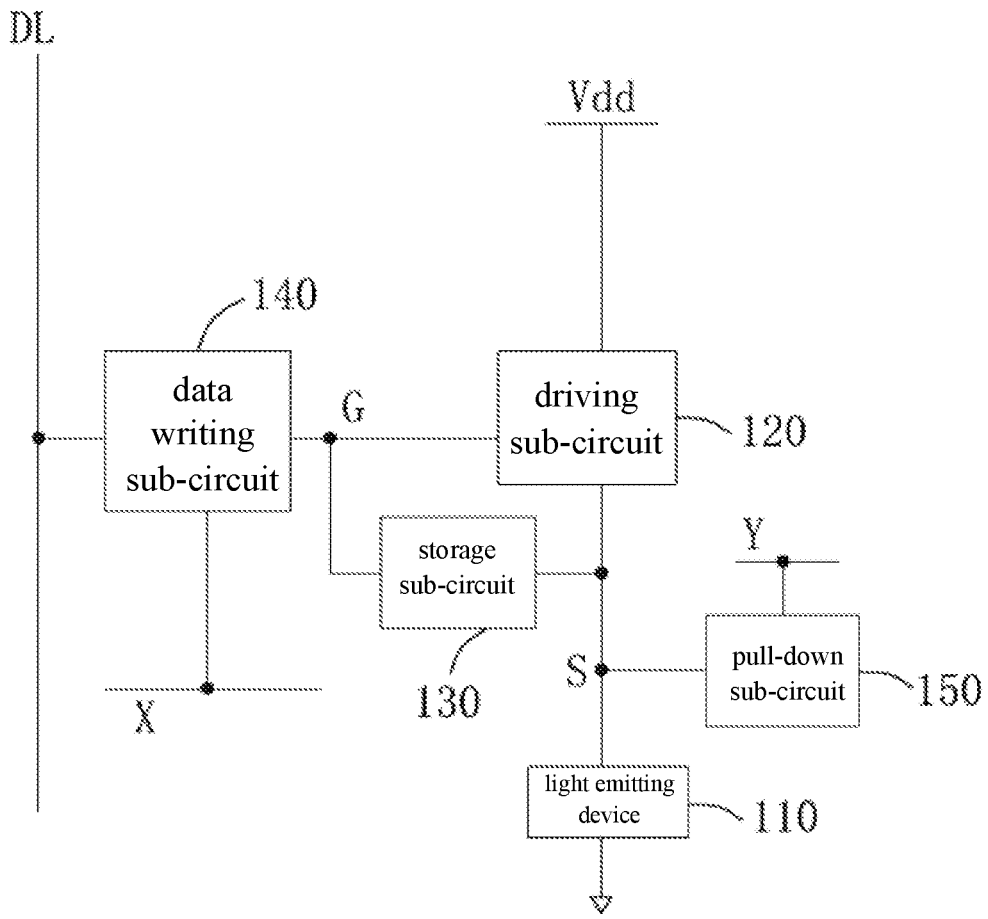
FIG. 1 is a schematic structural diagram of a pixel circuit according to some embodiments of the present disclosure.

The present disclosure provides a pixel circuit, as shown in FIG. 1, including a light emitting device 110, a driving sub-circuit 120, a storage sub-circuit 130, a data writing sub-circuit 140, and a pull-down sub-circuit 150;

the data writing sub-circuit 140 is configured to control the voltage signal on the data line dl (data line) to be written into the control end of the driving sub-circuit 120 in response to a data writing control signal;

a first end of the driving sub-circuit 120 is electrically connected to a power voltage Vdd, a second terminal of the driving sub-circuit 120 is electrically connected to a target node S, and the driving sub-circuit 120 is configured to control the driving sub-circuit 120 to be turned on under the control of a voltage at a control end thereof;

the energy storage sub-circuit 130 is electrically connected to the control end of the driving sub-circuit 120 and the second terminal of the driving sub-circuit 120, respectively, and is configured to control the voltage of the target node S;

the light emitting device 110 is electrically connected to the target node S;

the pull-down sub-circuit 150 is configured to control the voltage of the target node S in response to a pull-down control signal, so that the light emitting device 110 does not emit light.

In the embodiment of the disclosure, the pull-down sub-circuit controls the voltage of the target node in response to the pull-down control signal, so that the light-emitting device does not emit light, and thus, an original partial light-emitting stage in each frame can be converted into a black screen display stage, thereby shortening the light-emitting duration of the light-emitting device in each frame, achieving the purpose of reducing the phenomenon of dynamic image smear, and improving the display effect of the display device.

The Light Emitting device 110 may be an Organic Light-Emitting Diode (OLED), an anode of the OLED is connected to the target node S, and a cathode of the OLED is connected to the reference voltage terminal Vref. The on/off of the light emitting device 110 can be controlled by controlling the voltage value of the target node S. Of course, the light emitting device may also be other light emitting diodes, such as: quantum Dot Light Emitting Diodes (QLEDs), multi-partition Light distribution independent control leds (ULEDs), and the like.

The control end of the data writing sub-circuit 140 is connected to the data writing control line X, so that the control end of the data writing sub-circuit 140 can receive the data writing control signal provided by the data writing control line X. The second terminal of the data writing sub-circuit 140 is connected to the control end of the driving sub-circuit 120, and the first end of the data writing sub-circuit 140 is connected to the data line DL. When the control end of the data writing sub-circuit 140 receives the data writing control signal, the data writing sub-circuit 140 is turned on, so that the voltage signal on the data line DL can be written to the control end of the driving sub-circuit 120.

The first end of the driving sub-circuit 120 is connected to the power voltage terminal Vdd, and when the first end of the data writing sub-circuit 140 and the second terminal of the data writing sub-circuit 140 are turned on, the first end of the driving sub-circuit 120 and the second terminal of the driving sub-circuit 120 are controlled to be turned on according to the voltage of the control end of the driving sub-circuit 120. Therefore, the power of the power supply voltage terminal Vdd can be transmitted to the second terminal of the driving sub-circuit 120, and the potential of the second terminal of the driving sub-circuit 120 is pulled up, and the second terminal of the driving sub-circuit 120 is connected to the target node S, so that the potential of the target node S can also be pulled up.

The energy storage sub-circuit 130 is connected to the control end of the driving sub-circuit 120 and the second terminal of the driving sub-circuit 120, and the energy storage sub-circuit 130 stores energy after the control end of the driving sub-circuit 120 obtains a high-voltage signal.

The control end of the pull-down sub-circuit 150 is electrically connected to the pull-down control line Y, and when the pull-down control line Y provides a pull-down control signal, the pull-down sub-circuit 150 inputs a low-voltage signal to the target node S, so that the light emitting device 110 does not emit light, and a black screen display effect is obtained.

It should be noted that the high-voltage signal and the low-voltage signal of the target node S are both referred to the voltage signal of the reference voltage terminal Vref, the voltage difference between the high-voltage signal and the reference voltage is greater than or equal to the turn-on voltage of the light emitting device 110, and the voltage difference between the low-voltage signal and the reference voltage is less than the turn-on voltage of the light emitting device 110.

Figure 2:
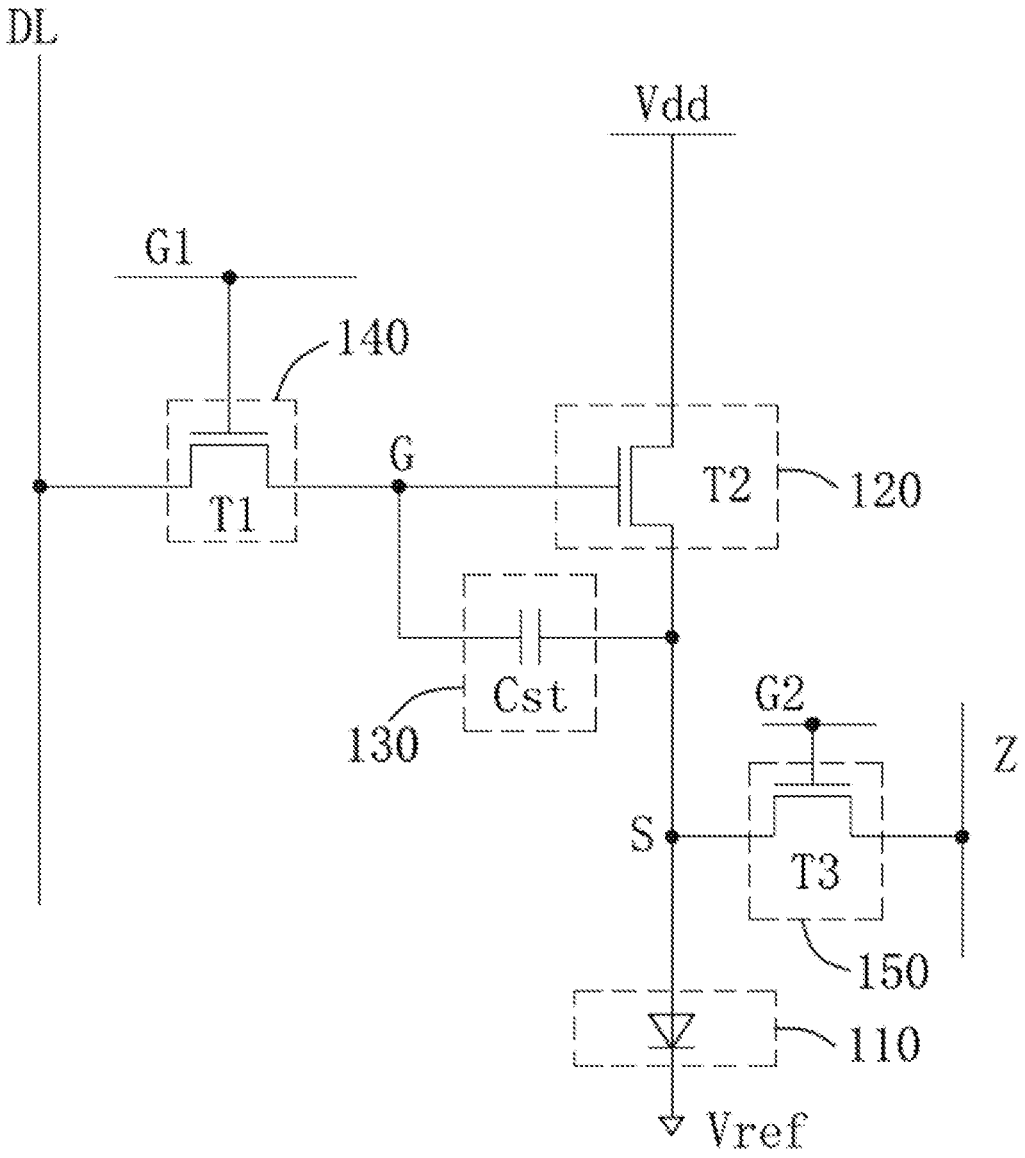
FIG. 2 is a schematic structural diagram of a pixel circuit according to some embodiments of the present disclosure.

Optionally, as shown in FIG. 2, the data writing sub-circuit 140 includes a data writing transistor T1, a control electrode of the data writing transistor T1 is electrically connected to the data writing control signal line X, a first electrode of the data writing transistor T1 is electrically connected to the data line DL, and a second electrode of the data writing transistor T1 is electrically connected to the control end of the driving sub-circuit 120.

In this embodiment, the data write transistor T1 can be turned on by the data write control line X inputting a high level signal to the gate of the data write transistor T1, and the voltage signal on the data line DL can be written into the control end of the drive sub-circuit 120. The data write control line X can disconnect the first end of the data write transistor T1 and the second terminal of the data write transistor T1 by inputting a low-level signal to the control electrode of the data write transistor T1, so that the voltage signal on the data line DL cannot be written to the control end of the driving sub-circuit 120.

The data write control line X may be a first gate line G1, and during a data write phase in a frame display period, the control electrode of the data write transistor T1 receives a high level signal provided by the first gate line G1, so that the first end of the data write transistor T1 and the second terminal of the data write transistor T1 can be turned on, and a voltage signal on the data line DL can be written into the control end of the driving sub-circuit 120.

Optionally, as shown in FIG. 2, the storage sub-circuit 130 includes a storage capacitor Cst, one end of the storage capacitor Cst is electrically connected to the control end of the driving sub-circuit 120, and the other end of the storage capacitor Cst is electrically connected to the second end of the driving sub-circuit 120.

The storage capacitor Cst is used to store a voltage between the control end of the driving sub-circuit 120 and the second terminal of the driving sub-circuit 120 during the data writing phase. And also for maintaining the high voltage of the control end of the driving sub-circuit 120 by bootstrap during the light emitting phase.

Optionally, as shown in FIG. 2, the driving sub-circuit 120 includes a driving transistor T2, a control electrode of the driving transistor T2 and a second electrode of the driving transistor T2 are electrically connected to two ends of the storage sub-circuit 130, respectively, and a first electrode of the driving transistor T2 is electrically connected to the power supply voltage Vdd.

Alternatively, as shown in FIG. 2, the pull-down sub-circuit 150 includes a first pull-down transistor T3, the control pole of the first pull-down transistor T3 is electrically connected to the pull-down control signal line Y, the first pole of the first pull-down transistor T3 is electrically connected to the pull-down signal line Z, and the second pole of the first pull-down transistor T3 is electrically connected to the target node S.

In the present embodiment, in the case where the target node S is at a high voltage to make the light emitting device 110 emit light, the gate of the first pull-down transistor T3 controls the first pull-down transistor T3 to be turned on in response to the pull-down control signal provided from the pull-down control signal line Y, to pull down the potential of the target node S so that the light emitting device 110 does not emit light.

The pull-down control signal line Y may be a second gate line G2, and the control electrode of the first pull-down transistor T3 receives the high-level signal provided by the second gate line G2 during the black screen display period of one frame of the image display period, so that the first end of the first pull-down transistor T3 and the second terminal of the first pull-down transistor T3 can be turned on, and the low-voltage signal on the pull-down signal line Z pulls down the potential of the target node S.

Figure 3:
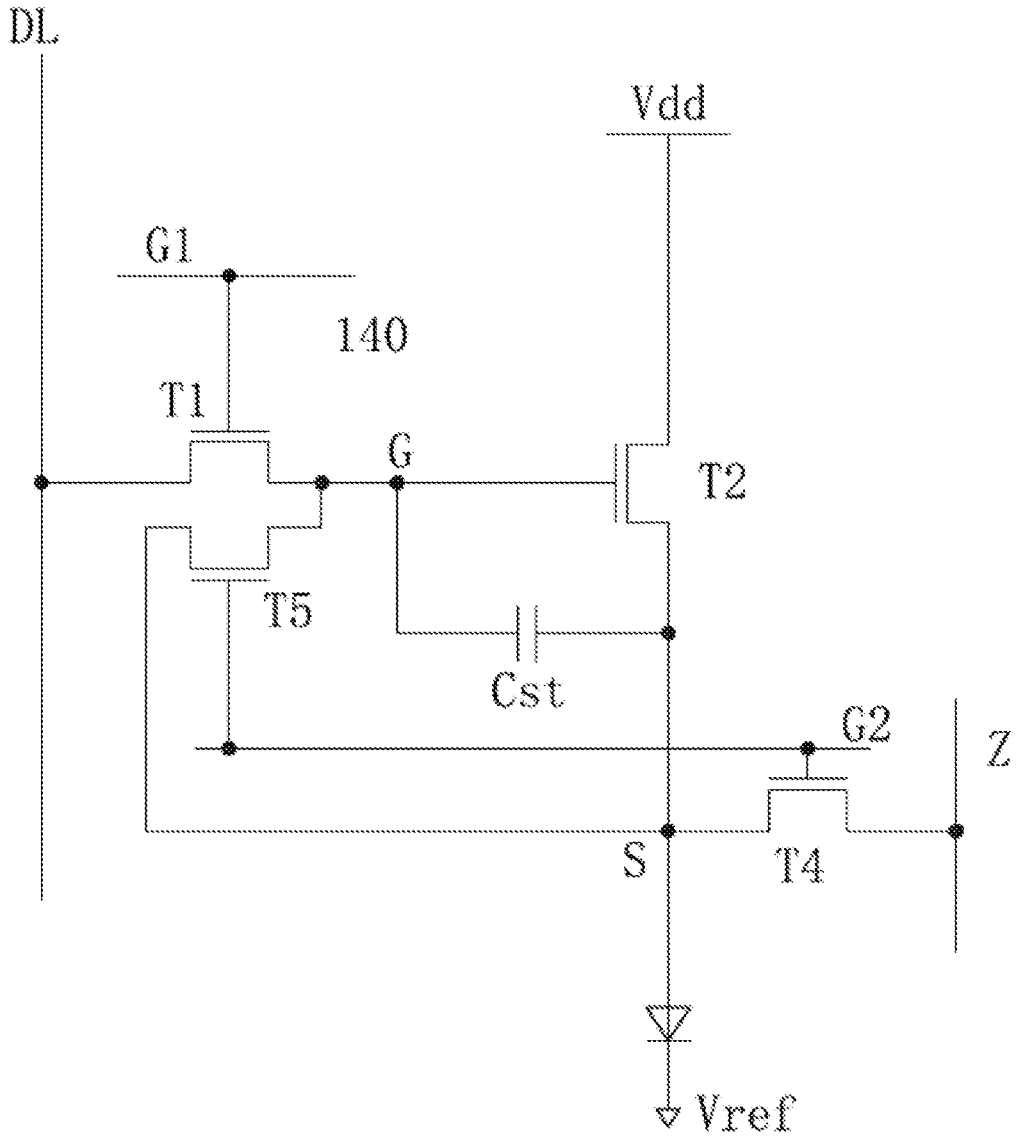
FIG. 3 is a schematic structural diagram of a pixel circuit according to some embodiments of the present disclosure.

Alternatively, as shown in FIG. 3, the pull-down sub-circuit 150 includes a second pull-down transistor T4 and a third pull-down transistor T5;

a control electrode of the second pull-down transistor T4 is electrically connected to the pull-down control signal line G2, a first electrode of the second pull-down transistor T4 is electrically connected to the pull-down signal line Z, and a second electrode of the second pull-down transistor T4 is electrically connected to the target node S;

a control electrode of the third pull-down transistor T5 is electrically connected to the pull-down control signal line G2, a first electrode of the third pull-down transistor T5 is electrically connected to the target node S, and a second electrode of the third pull-down transistor T5 is electrically connected to the control end of the driving sub-circuit 120.

In this embodiment, in a case where the target node S is at a high voltage to cause the light emitting device 110 to emit light, the gate of the second pull-down transistor T4 controls the second pull-down transistor T4 to be turned on in response to the pull-down control signal provided by the pull-down control signal line G2, and the pull-down signal line Z pulls down the voltage of the target node S, so that the light emitting device 110 does not emit light.

In addition, the gate of the third pull-down transistor T5 controls the third pull-down transistor T5 to be turned on in response to the pull-down control signal provided by the pull-down control signal line G2, so that the control end of the driving sub-circuit 120 is connected to the target node S at the low potential, and the first end of the driving sub-circuit 120 and the second terminal of the driving sub-circuit 120 are disconnected from each other by the potential of the control end of the pull-down driving sub-circuit 120, so that the target node S cannot receive the voltage signal of the power supply voltage Vdd.

Figure 4:
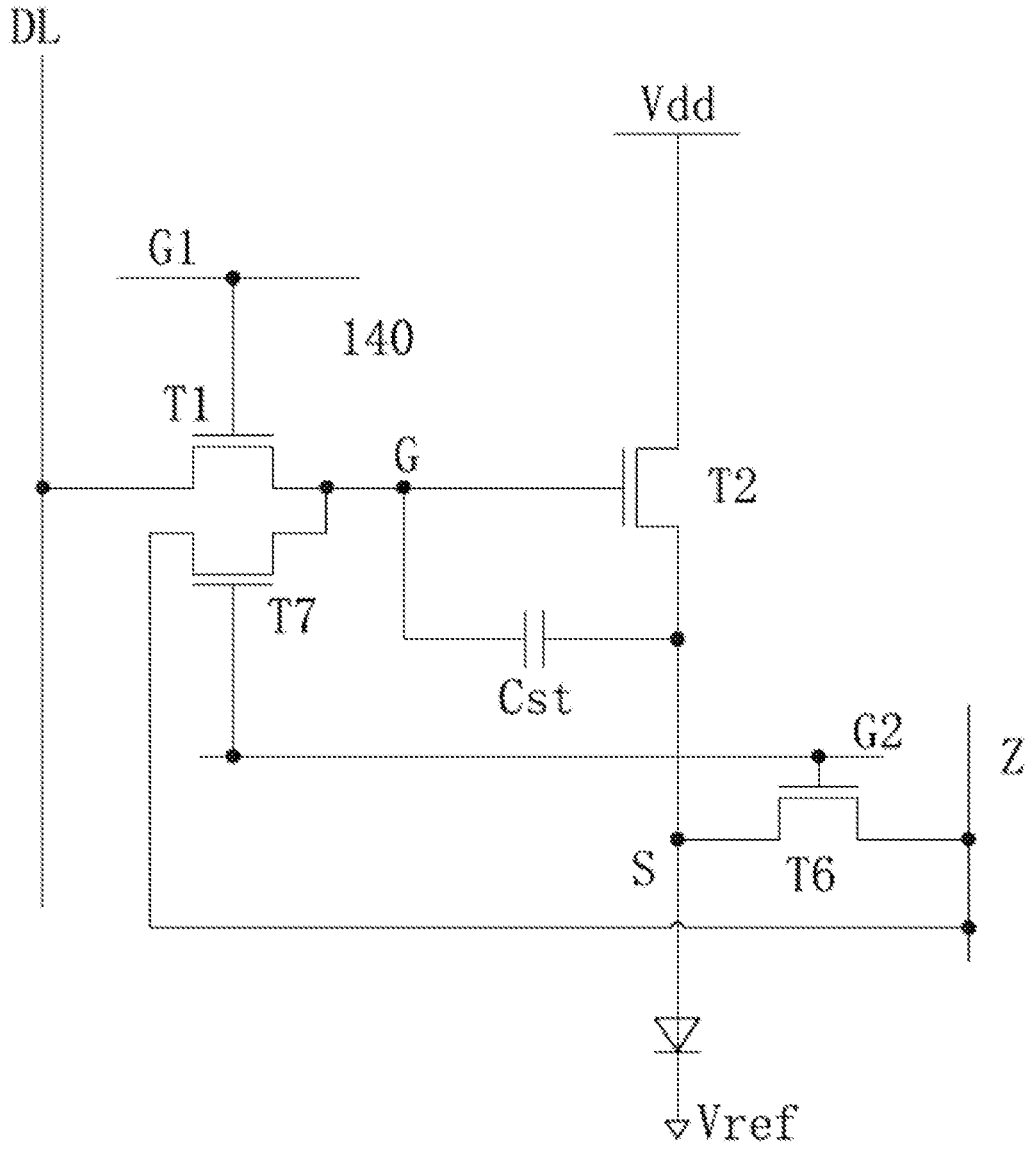
FIG. 4 is a schematic structural diagram of a pixel circuit according to some embodiments of the present disclosure.

Alternatively, as shown in FIG. 4, the pull-down sub-circuit 150 includes a fourth pull-down transistor T6 and a fifth pull-down transistor T7;

a control electrode of the fourth pull-down transistor T6 is electrically connected to the pull-down control signal line G2, a first electrode of the fourth pull-down transistor T6 is electrically connected to the pull-down signal line Z, and a second electrode of the fourth pull-down transistor T6 is electrically connected to the target node S;

a control electrode of the fifth pull-down transistor T7 is electrically connected to the pull-down control signal line G2, a first electrode of the fifth pull-down transistor T7 is electrically connected to the pull-down signal line Z, and a second electrode of the fifth pull-down transistor T7 is electrically connected to the control end of the driving sub-circuit 120.

In this embodiment, when the target node S is at a high voltage to make the light emitting device 110 emit light, the gate of the fourth pull-down transistor T6 controls the fourth pull-down transistor T6 to be turned on in response to the pull-down control signal provided by the pull-down control signal line G2, and the pull-down signal line Z pulls down the voltage of the target node S, so that the light emitting device 110 does not emit light.

The gate of the fifth pull-down transistor T7 controls the fifth pull-down transistor T7 to be turned on in response to the pull-down control signal provided by the pull-down control signal line G2, so as to pull down the potential of the control end of the driving sub-circuit 120, and disconnect the first end of the driving sub-circuit 120 and the second terminal of the driving sub-circuit 120, thereby making the target node S unable to receive the voltage signal of the power supply voltage Vdd.

Optionally, the voltage signal provided by the data line DL in the data writing phase is a high-voltage signal, and the voltage signal provided by the data line DL in the light-emitting phase and the black screen display phase is a low-voltage signal;

in the light-emitting period and the non-light-emitting period, the data line DL is reused as the pull-down signal line.

The pull-down signal line Z is used for providing a voltage of a low-voltage signal pull-down target node S, and in the embodiment, in the light-emitting stage and the black screen display stage, the voltage signal provided by the data line DL is a low-voltage signal, so that the data line DL can replace the pull-down signal line Z in the light-emitting stage and the black screen display stage, and internal wiring of the display device can be saved on the premise of achieving the same effect.

Figure 5:
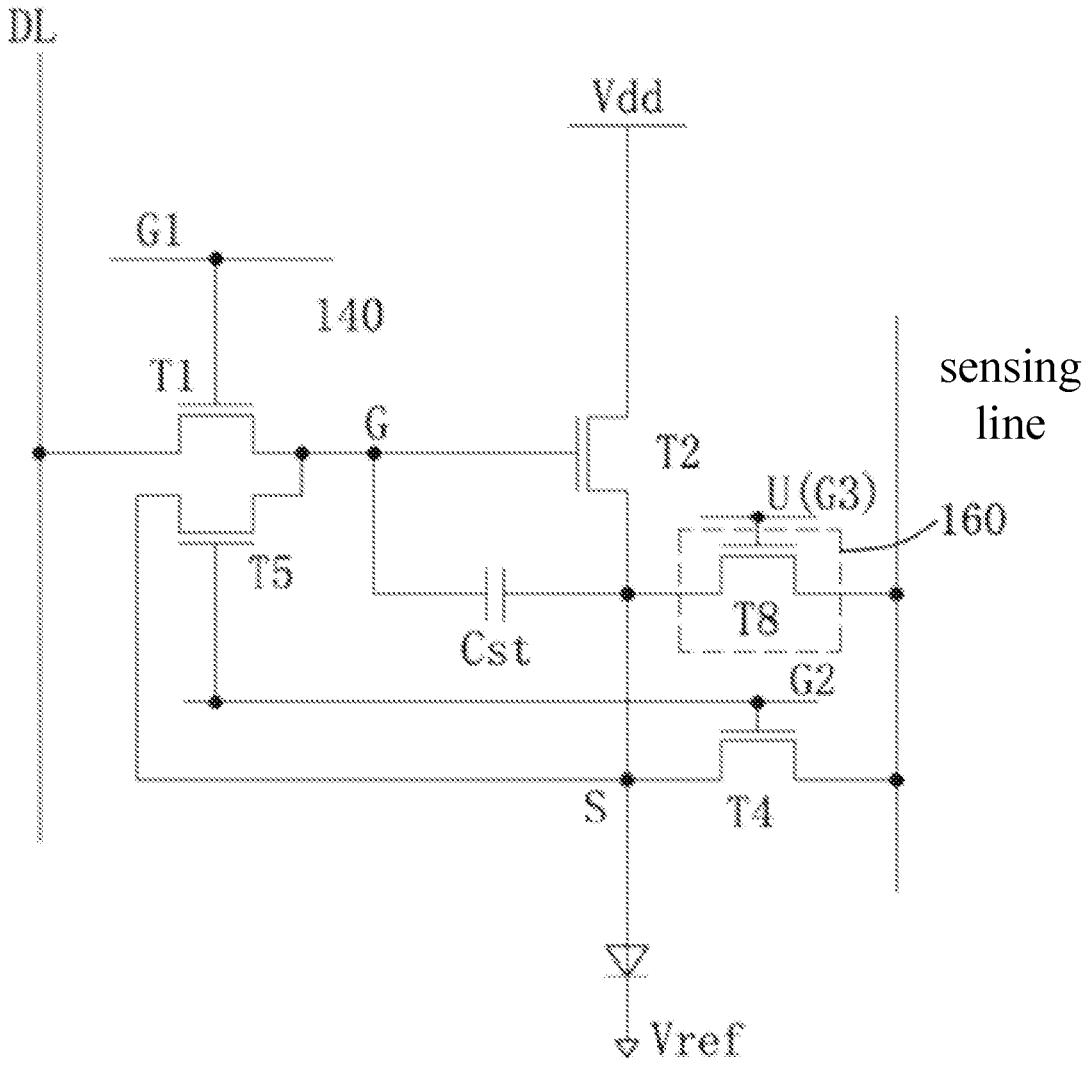
FIG. 5 is a schematic structural diagram of a pixel circuit according to some embodiments of the present disclosure.

Optionally, as shown in FIG. 5, a sensing write sub-circuit 160 is further included, where the sensing write sub-circuit 160 is configured to control the sensing line Sense to connect to the second terminal of the driving sub-circuit 120 in response to a sensing write control signal provided by the sensing write control line U.

The sensing write sub-circuit 160 is used for writing the low-voltage signal provided by the sensing line Sense into the second terminal of the driving sub-circuit 120 during the data write phase, so as to increase the potential difference between the two terminals of the energy storage sub-circuit 130, and improve the energy storage of the energy storage sub-circuit 130.

The sensing write sub-circuit 160 includes a sensing write transistor T8, a control electrode of the sensing write transistor T8 is connected to a sensing write control line U, a first electrode of the sensing write transistor T8 is connected to the second terminal of the driving sub-circuit 120, and a second electrode of the sensing write transistor T8 is connected to a sensing line Sense.

The control electrode of the sensing write transistor T8 controls the sensing write transistor T8 to be turned on in response to a sensing write control signal provided by the sensing write control line U, so that the sensing line Sense is communicated with the second terminal of the driving sub-circuit 120.

The sensing write control line U may be a third gate line G3, and in a data write phase within a frame display period, the control electrode of the sensing write transistor T8 receives a high level signal provided by the third gate line G3, so that the first end of the sensing write transistor T8 and the second terminal of the sensing write transistor T8 can be turned on, and a voltage signal on the sensing line Sense can be written into the first end of the driving sub-circuit 120.

Optionally, a voltage signal of the Sense line Sense in a data writing stage is a low-voltage signal;

in the data writing stage, the sensing line Sense is reused as the pull-down signal line.

The pull-down signal line Z is used for providing a low-voltage signal to pull down the voltage of the target node S, and in the data writing stage in the embodiment, the voltage signal provided by the Sense line Sense is a low-voltage signal, so that the Sense line Sense can replace the pull-down signal line Z in the data writing stage, and internal routing of the display device can be saved on the premise of achieving the same effect.

Optionally, the data write control line X is reused as the sensing write control line U.

In this embodiment, in the data writing stage: the control end of the data writing sub-circuit 140 controls the data writing sub-circuit 140 to be turned on in response to the high-voltage signal provided by the data writing control line X; the control end of the sensing write sub-circuit 160 controls the sensing write sub-circuit 160 to be turned on in response to the high-voltage signal provided by the sensing write control line U.

In the light-emitting stage and the black screen display stage: the control end of the data writing sub-circuit 140 responds to the low-voltage signal provided by the data writing control line X to control the disconnection of the first end of the data writing sub-circuit 140 from the second terminal of the data writing sub-circuit 140; the control end of the sensing write sub-circuit 160 controls the first end of the sensing write sub-circuit 160 to be disconnected from the second terminal of the sensing write sub-circuit 160 in response to the low-voltage signal provided by the sensing write control line U.

Figure 6:
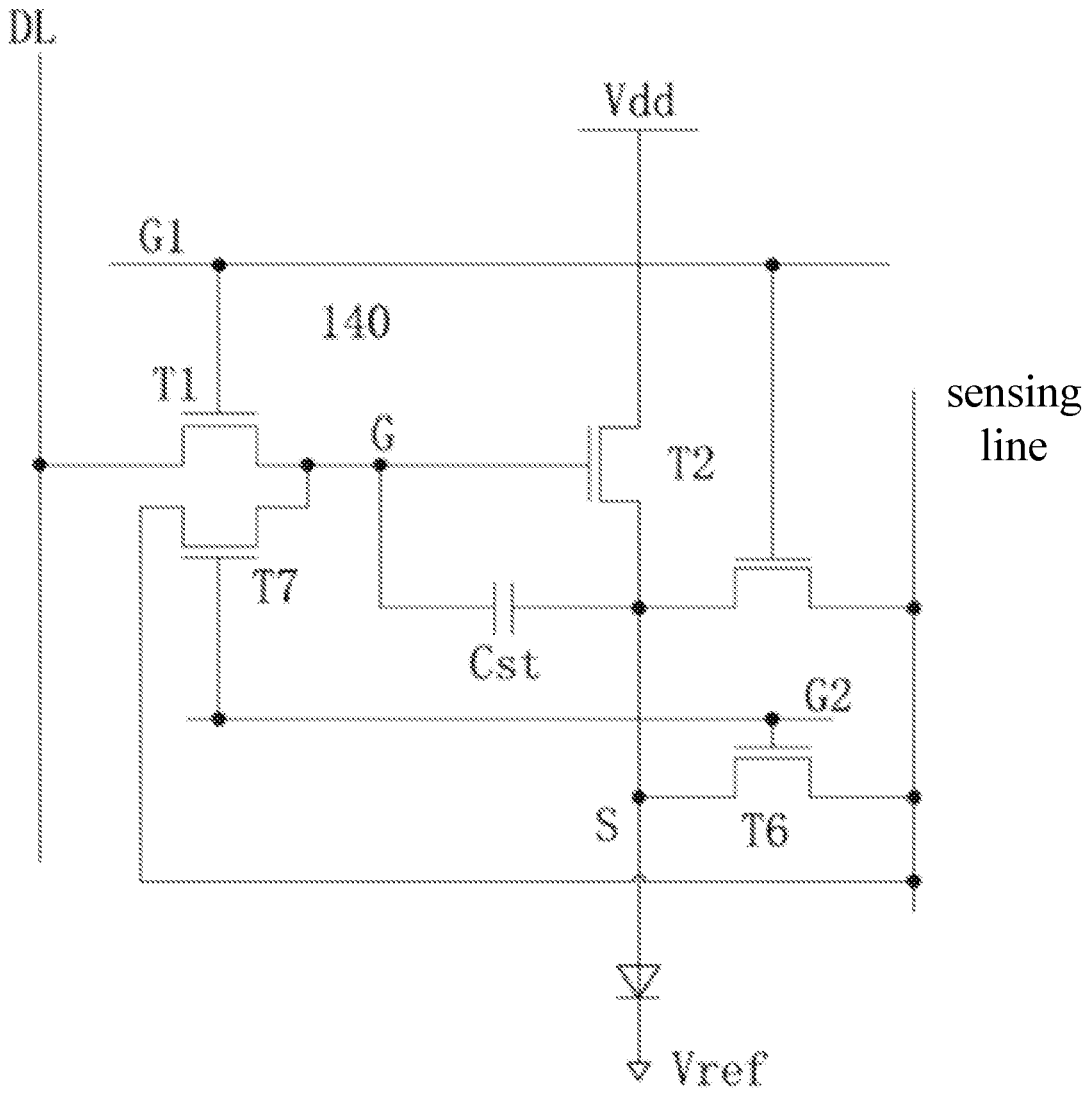
FIG. 6 is a schematic structural diagram of a pixel circuit according to some embodiments of the present disclosure.

It can be seen that the voltage signal provided by the data write control line X and the voltage signal provided by the sensing write control line U change the same at each stage, and can be replaced by each other to save the wiring of the display device without affecting their functions. When the first gate line G1 multiplexes the data write control line X and the third gate line G3 multiplexes the sensing write control line U, as shown in FIG. 6.

The embodiment of the present disclosure further provides a driving method of the pixel circuit, where a display cycle includes a data writing phase, a light emitting phase, and a black screen display phase, and the method includes:

in a data writing phase, the data writing sub-circuit responds to a data writing control signal and provides a high-voltage signal in the data line to the control end of the driving sub-circuit so as to charge the energy storage sub-circuit, and therefore the voltage of the control end of the driving sub-circuit is increased;

in a light-emitting stage, the data writing sub-circuit disconnects the control end of the driving sub-circuit, and the driving sub-circuit controls the driving sub-circuit to be conducted under the control of the control end of the driving sub-circuit, so that the light-emitting device is communicated with the power supply voltage end, and the light-emitting device emits light;

in a black screen display stage, the pull-down sub-circuit controls the voltage of the target node in response to a pull-down control signal so that the light emitting device does not emit light.

In the embodiment of the disclosure, the pull-down sub-circuit controls the voltage of the target node in response to a pull-down control signal provided by a pull-down control line, so that the light-emitting device does not emit light, and thus, an original partial light-emitting stage can be converted into a black screen display stage in each frame, thereby shortening the light-emitting time of a pixel in each frame, achieving the purpose of reducing the phenomenon of dynamic image smear, and improving the display effect of the display device. Therefore, the technical scheme provided by the disclosure can reduce the phenomenon of dynamic image smear and improve the display effect of the display device.

Figure 7:
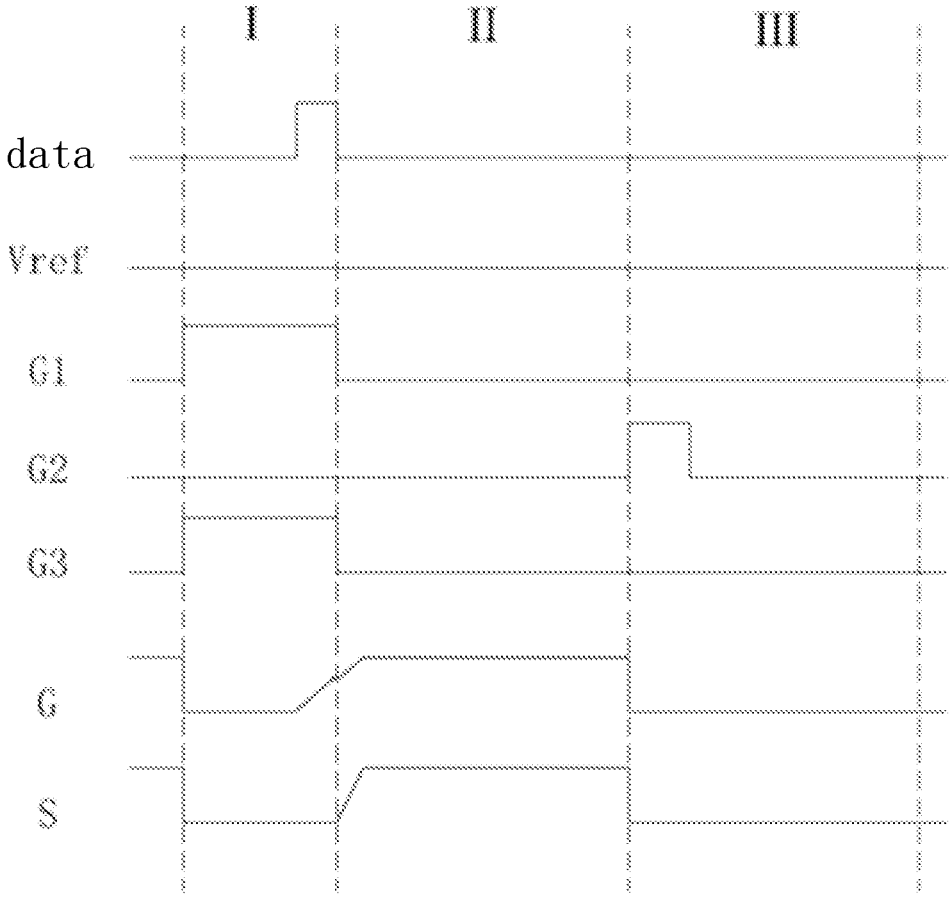
FIG. 7 is a timing diagram of a driving method of a pixel circuit according to some embodiments of the present disclosure.

A description will be given of a driving method of a pixel circuit, taking the structure shown in FIG. 2 as an example:

in the data writing phase i: as shown in FIG. 7, the Data write control line G1 provides a high-voltage signal, the pull-down control line G2 provides a low-voltage signal, the Data line Data provides a low-voltage signal during a first period of time, and provides a high-voltage signal during a second period of time other than the first period of time, both of the first and second periods of time belong to a Data write phase;

at this time, the Data writing transistor T1 is turned on, and the high-voltage signal provided by the Data line Data is written into the first end of the storage capacitor Cst during the first period of time, so that the storage capacitor Cst stores energy. The first pole of the first pull-down transistor T3 and the second pole of the first pull-down transistor T3 are off.

In the first period, the potential of the control electrode of the driving transistor T2 is continuously rising, but the first electrode of the driving transistor T2 and the second electrode of the driving transistor T2 are not yet enabled to be connected, and G in FIG. 7 is the potential of the control electrode of the driving transistor T2.

In the luminescence phase II: the Data write control line G1, the pull-down control line G2, and the Data line Data all provide low-voltage signals.

At this time, the first pole of the data write transistor T1 and the second pole of the data write transistor T1 are turned off, and the first pole of the first pull-down transistor T3 and the second pole of the first pull-down transistor T3 are turned off.

The storage capacitor Cst discharges, so that the potential of the control electrode of the driving transistor T2 continues to rise until the first electrode of the driving transistor T2 and the second electrode of the driving transistor T2 are connected, and thus the power voltage Vdd is connected to the light emitting device, and the light emitting device emits light. In FIG. 7, S is the potential of the target node, and is maintained at a high voltage after being pulled up.

In the black screen display stage iii: as shown in FIG. 7, the Data write control line G1 and the Data line Data each supply a low-voltage signal, and the pull-down control line G2 supplies a high-voltage signal in the start period of the black screen display phase.

At this time, the first pole of the data writing transistor T1 and the second pole of the data writing transistor T1 are turned off. The first pull-down transistor T3 is turned on.

The target node S is connected to the pull-down signal line Z, and the potential of the target node S is pulled down, so that the light emitting device does not emit light, and the display device displays a black screen.

Alternatively, a pixel circuit as shown in FIG. 5;

the step of the pull-down sub-circuit controlling the voltage of the target node in response to a pull-down control signal so that the light emitting device does not emit light includes:

the second pull-down transistor responds to a pull-down control signal and controls a pull-down signal line to pull down the voltage of the target node; the third pull-down transistor pulls down a voltage of the control end of the driving sub-circuit in response to a pull-down control signal so that the light emitting device does not emit light.

In the data writing phase: as shown in FIG. 7, the Data write control line G1 and the sensing write control line G3 both provide a high-voltage signal, the pull-down control line G2 provides a low-voltage signal, the Data lines Data provide a low-voltage signal in a first period and provide a high-voltage signal in a second period other than the first period, and the first period and the second period both belong to a Data write phase;

at this time, the Data writing transistor T1 is turned on, the high-voltage signal provided by the Data line Data is written into the first end of the storage capacitor Cst during the first time period, the sensing writing transistor T8 is turned on, and the low-voltage signal provided by the sensing line Sense is written into the second terminal of the storage capacitor Cst, so that the storage capacitor Cst stores energy. The first pole of the second pull-down transistor T4 and the second pole of the second pull-down transistor T4 are turned off, and the first pole of the third pull-down transistor T5 and the second pole of the third pull-down transistor T5 are turned off.

In the first period, the potential of the control electrode of the driving transistor T2 is continuously rising, but the first electrode of the driving transistor T2 and the second electrode of the driving transistor T2 are not yet enabled to be connected, and G in FIG. 7 is the potential of the control electrode of the driving transistor T2.

In the light emitting stage: as shown in FIG. 7, the Data write control line G1, the sensing write control line G3, the pull-down control line G2, and the Data lines Data all provide low-voltage signals.

At this time, the first pole of the data writing transistor T1 and the second pole of the data writing transistor T1 are turned off, and the first pole of the sensing writing transistor T8 and the second pole of the sensing writing transistor T8 are turned off. The first pole of the second pull-down transistor T4 and the second pole of the second pull-down transistor T4 are turned off, and the first pole of the third pull-down transistor T5 and the second pole of the third pull-down transistor T5 are turned off.

The storage capacitor Cst discharges, so that the potential of the control electrode of the driving transistor T2 continues to rise until the first electrode of the driving transistor T2 and the second electrode of the driving transistor T2 are connected, so that the power voltage Vdd is connected to the light emitting device, and at this time, the target node is at a high potential, and the light emitting device realizes light emission. In FIG. 7, S is the potential of the target node, and is maintained at a high voltage after being pulled up.

In the black screen display stage: as shown in FIG. 7, the Data write control line G1, the sensing write control line G3, and the Data line Data all supply low-voltage signals, and the pull-down control line G2 supplies high-voltage signals in the beginning period of the black screen display phase.

At this time, the first pole of the data writing transistor T1 and the second pole of the data writing transistor T1 are turned off, and the first pole of the sensing writing transistor T8 and the second pole of the sensing writing transistor T8 are turned off. The second pull-down transistor T4 is turned on, and the third pull-down transistor T5 is turned on.

The target node S is connected to the Sense line Sense, the potential of the target node S is pulled down, the control electrode of the driving transistor T2 is connected to the target node S, the potential of the control electrode of the driving transistor T2 is pulled down, the first electrode of the driving transistor T2 and the second electrode of the driving transistor T2 are disconnected, the light emitting device is disconnected from the power voltage Vdd, and thus the light emitting device does not emit light, and the display substrate displays a black screen.

In this embodiment, the potential of the target node S and the potential of the control electrode of the driving transistor T2 are pulled down at the same time, so that the connection between the target node S and the power supply voltage Vdd can be further disconnected, the potential of the target node S is ensured not to be pulled up by the power supply voltage Vdd, and the stability of black screen display is ensured.

The embodiment of the disclosure also provides a display device, which includes the pixel circuit.

The display device may be a display, a mobile phone, a tablet computer, a television, a wearable electronic device, a navigation display device, or the like.

Figure 8:
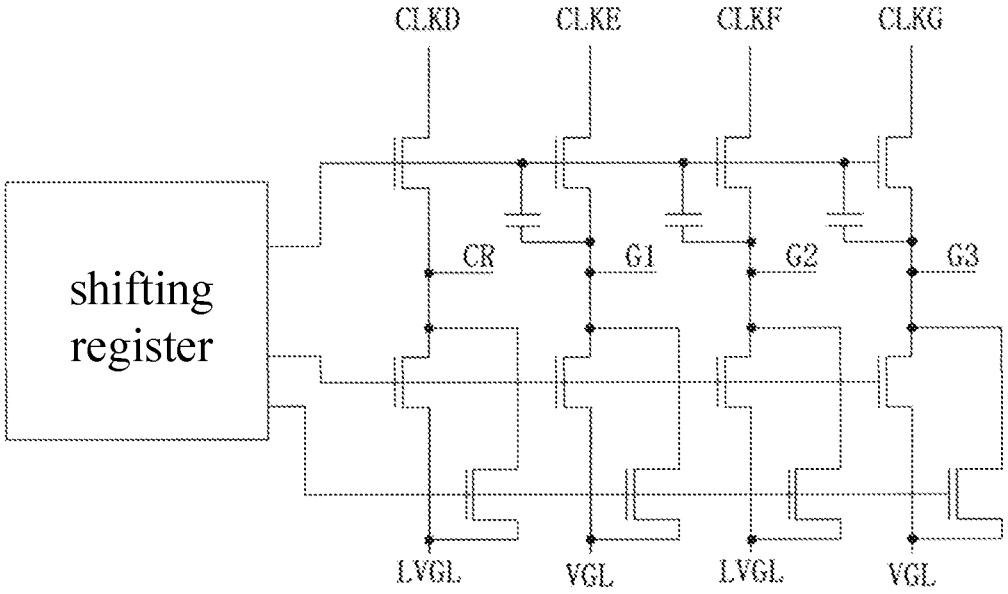
FIG. 8 is a schematic structural diagram of a driving circuit corresponding to a pixel circuit in a display device according to some embodiments of the present disclosure.

Further, the display device further includes a Gate Driver on Array (GOA) unit, as shown in FIG. 8. The GOA unit in this embodiment is used to drive the pixel circuit shown in FIG. 5, and the GOA unit outputs a high-voltage signal or a low-voltage signal through three output signals G1, G2, and G3 as shown in the timing diagram of FIG. 7, so as to complete driving of the pixel circuit.

Unless defined otherwise, technical or scientific terms used herein shall have the ordinary meaning as understood by one of ordinary skill in the art to which this disclosure belongs. The use of "first," "second," and the like in this disclosure is not intended to indicate any order, quantity, or importance, but rather is used to distinguish one element from another. The word "comprising" or "comprises", and the like, means that the element or item preceding the word comprises the element or item listed after the word and its equivalent, but does not exclude other elements or items. The terms "connected" or "coupled" and the like are not restricted to physical or mechanical connections, but may include electrical connections, whether direct or indirect. "upper", "lower", "left", "right", and the like are used only to indicate relative positional relationships, and when the absolute position of the object being described is changed, the relative positional relationships may also be changed accordingly.

It will be understood that when an element such as a layer, film, region or substrate is referred to as being "on" or "under" another element, it can be "directly on" or "under" the other element or intervening elements may be present.

While the embodiments of the present disclosure have been described in connection with the appended drawings, the present disclosure is not limited to the specific embodiments, which have been described above for illustrative purposes only and not for purposes of limitation, and it will be appreciated by those of ordinary skill in the art that, in light of the present disclosure, numerous modifications may be made without departing from the spirit of the disclosure and scope of the appended claims.

What is claimed is:

1. A pixel circuit, comprising a light emitting device, a driving sub- circuit, an energy storage sub-circuit, a data writing sub-circuit and a pull-down sub-circuit;

the data writing sub-circuit is configured to control a voltage signal on a data line to be written into a control end of the driving sub-circuit in response to a data writing control signal;

a first end of the driving sub-circuit is electrically connected to a target node, a second end of the driving sub-circuit is electrically connected to a power supply voltage, and the driving sub-circuit is configured to control a conduction of the driving sub-circuit under a control of a voltage on a control end of the driving sub-circuit;

the energy storage sub-circuit is electrically connected to the control end of the driving sub-circuit and the first end of the driving sub-circuit and is configured to control a voltage of the target node;

the light emitting device is electrically connected to the target node; and the pull-down sub-circuit is configured to control the voltage of the target node in response to a pull-down control signal, to make the light-emitting device not to emit light;

wherein the pull-down sub-circuit comprises a second pull-down transistor and a third pull-down transistor;

a control electrode of the second pull-down transistor is electrically connected to the pull-down control signal line, a first electrode of the second pull-down transistor is electrically connected to the pull-down signal line, and a second electrode of the second pull-down transistor is electrically connected to the target node;

a control electrode of the third pull-down transistor is electrically connected to the pull- down control signal line, a first electrode of the third pull-down transistor is electrically connected to the target node, and a second electrode of the third pull-down transistor is electrically connected to the control end of the driving sub-circuit; or wherein the pull-down sub-circuit comprises a fourth pull-down transistor and a fifth pull-down transistor;

a control electrode of the fourth pull-down transistor is electrically connected to the pull-down control signal line, a first electrode of the fourth pull-down transistor is electrically connected to the pull-down signal line, and a second electrode of the fourth pull-down transistor is electrically connected to the target node;

a control electrode of the fifth pull-down transistor is electrically connected to the pull- down control signal line, a first electrode of the fifth pull-down transistor is electrically connected to the pull-down signal line, and a second electrode of the fifth pull-down transistor is electrically connected to the control end of the driving sub-circuit.

2. The pixel circuit according to claim 1, wherein a voltage signal provided by the data line in a data writing phase is a high-voltage signal, and a voltage signal provided by the data line in a light emitting phase and a black screen display phase is a low-voltage signal;

in the light-emitting stage and the black screen display stage, the data line is reused as the pull-down signal line.

3. The pixel circuit according to claim 1, further comprising a sensing write sub-circuit configured to control a sense line to connect to the first end of the drive sub-circuit in response to a sensing write control signal.

4. The pixel circuit according to claim 3, wherein a voltage signal of the sensing line in the data writing phase is a low-voltage signal;

in the data writing stage, the sensing line is reused as the pull-down signal line.

5. The pixel circuit according to claim 3, wherein the data writing control signal is reused as the sensing write control signal.

6. A display device comprising the pixel circuit according to claim 1.

7. A driving method of pixel circuit, wherein a display period comprises a data writing stage, a light emitting stage and a black screen display stage, the pixel circuit comprises a light emitting device, a driving sub-circuit, an energy storage sub-circuit, a data writing sub-circuit and a pull-down sub-circuit;

the data writing sub-circuit is configured to control a voltage signal on a data line to be written into a control end of the driving sub-circuit in response to a data writing control signal;

a first end of the driving sub-circuit is electrically connected to a target node, a second end of the driving sub-circuit is electrically connected to a power supply voltage, and the driving sub-circuit is configured to control a conduction of the driving sub-circuit under a control of a voltage on a control end of the driving sub-circuit;

the energy storage sub-circuit is electrically connected to the control end of the driving sub-circuit and the first end of the driving sub-circuit and is configured to control a voltage of the target node;

the light emitting device is electrically connected to the target node; and the pull-down sub-circuit is configured to control the voltage of the target node in response to a pull-down control signal, to make the light-emitting device not to emit light;

the method comprises:

in the data writing phase, the data writing sub-circuit providing a high-voltage signal in the data line to the control end of the driving sub-circuit in response to a data writing control signal, to charge the energy storage sub-circuit to increase a voltage of the control end of the driving sub-circuit;

in the light-emitting stage, the data writing sub-circuit disconnecting with the control end of the driving sub-circuit, and the driving sub-circuit controlling the driving sub-circuit to be conducted under a control of the control end of the driving sub-circuit, to enable the light-emitting device to connect to the power supply voltage end and enable the light-emitting device to emit light;

in the black screen display stage, the pull-down sub-circuit controlling the voltage of the target node in response to a pull-down control signal, to make the light emitting device not emit light;

wherein the pull-down sub-circuit comprises a second pull-down transistor and a third pull-down transistor; the pull-down sub-circuit controlling the voltage of the target node in response to the pull-down control signal to enable the light emitting device not emit light comprises:

the second pull-down transistor controlling a pull-down signal line to pull down the voltage of the target node in response to a pull-down control signal;

the third pull-down transistor pulls down a voltage of the control end of the driving sub-circuit in response to the pull-down control signal, to make the light emitting device not emit light; or wherein the pull-down sub-circuit comprises a fourth pull-down transistor and a fifth pull-down transistor;

the pull-down sub-circuit controlling the voltage of the target node in response to the pull-down control signal to make the light emitting device not emit light comprises:

the fourth pull-down transistor controlling a pull-down signal line to pull down the voltage of the target node in response to a pull-down control signal;

the fifth pull-down transistor pulling down a voltage of the control end of the driving sub-circuit in response to the pull-down control signal, to make the light emitting device not emit light.

8. The method according to claim 7, wherein a voltage signal provided by the data line in the data writing phase is a high-voltage signal, and a voltage signal provided by the data line in the light-emitting phase and the black screen display phase is a low-voltage signal;

in the light-emitting stage and the black screen display stage, the data line is reused as the pull-down signal line.

9. The method according to claim 7, further comprising a sensing write sub-circuit configured to control a sense line to connect to the first end of the drive sub-circuit in response to a sensing write control signal.

10. The method according to claim 9, wherein the voltage signal of the sensing line in the data writing phase is a low-voltage signal;

in the data writing stage, the sensing line is reused as the pull-down signal line.

11. The method according to claim 9, wherein the data writing control signal is reused as the sensing write control signal.

* * * * *